US009473862B2

(12) United States Patent
Stromsted

(10) Patent No.: US 9,473,862 B2
(45) Date of Patent: Oct. 18, 2016

(54) METHOD AND SYSTEM FOR PROVIDING A HEARING AID

(75) Inventor: Christian Stromsted, Aarberg (CH)

(73) Assignee: Sonetik AG, Bern (CH)

( * ) Notice: Subject to any disclaimer, the term of this patent is extended or adjusted under 35 U.S.C. 154(b) by 1103 days.

(21) Appl. No.: 12/784,440

(22) Filed: May 20, 2010

(65) Prior Publication Data

US 2010/0234757 A1 Sep. 16, 2010

Related U.S. Application Data

(63) Continuation of application No. PCT/CH2007/000585, filed on Nov. 22, 2007.

(51) Int. Cl.
*H04R 25/00* (2006.01)

(52) U.S. Cl.
CPC ..... *H04R 25/70* (2013.01)

(58) Field of Classification Search
CPC ..... H04R 25/70
USPC ..... 600/559
See application file for complete search history.

(56) References Cited

FOREIGN PATENT DOCUMENTS

| | | | |
|---|---|---|---|
| EP | 0 064 042 | A1 | 11/1982 |
| WO | WO 00/78096 | A2 | 12/2000 |
| WO | WO 01/69969 | A2 | 9/2001 |
| WO | WO 2005/125281 | A1 | 12/2005 |

OTHER PUBLICATIONS

International Search Report and Written Opinion for PCT Application No. PCT/CH2007/000585, 17 pp, (mailed Aug. 14, 2008).

*Primary Examiner* — Lee S Cohen
*Assistant Examiner* — Emily Lloyd
(74) *Attorney, Agent, or Firm* — Klarquist Sparkman, LLP

(57) ABSTRACT

A method for providing a hearing aid, which is adapted to the individual needs of a hearing aid user, wherein hearing loss data is measured on an individual. In order to allow time and cost savings during the fitting procedure of said hearing aid and to provide a ready-to-wear hearing aid the method comprises the steps of—assessing the admissibility of the measured hearing loss by determining if said measured hearing loss data is located within a predetermined admissibility range; attributing said measured hearing loss data to one of a set of standardized profiles, wherein each standardized profile corresponds to a certain type of hearing loss generally located within said admissibility range and is associated with a set of standardized programming parameters of a hearing aid; providing a hearing aid (104, 114) which is programmed according to the set of standardized programming parameters that is associated with said attributed standardized profile.

19 Claims, 7 Drawing Sheets

METHOD AND SYSTEM FOR PROVIDING A HEARING AID

CROSS REFERENCE TO RELATED APPLICATIONS

This is a continuation of PCT Application No. PCT/CH2007/000585, filed Nov. 22, 2007, which was published in English under PCT Article 21(2), which is incorporated herein by reference.

The present invention pertains to a method for providing a hearing aid, which is adapted to the individual needs of a hearing aid user, according to the preamble of claim 1 or claim 15 or claim 16. It also relates to a system for providing a hearing aid according to the preamble of claim 18 or claim 19 or claim 21, a set of hearing aids according to the preamble of claim 17, a hearing aid according to the preamble of claim 20 and a computer software product according to the preamble of claim 22.

Typically, the successful preparation of a hearing device to reasonably satisfy the individual needs of a hearing-impaired consumer depends on an expert, usually a trained audiologist, recording and correctly assessing 1) the individual's hearing ability as expressed by a pure-tone audiogram, and 2) the individual's personality, lifestyle and other characteristics of how the individual functions in everyday life. To be able to prepare the hearing device for an individual, the expert relies not only on the input of the individual but also on the tools and training made available to him by the hearing device manufacturer as well as on the capabilities of the hearing device.

By far the most important and influential aspect for determining the individual's satisfaction with a hearing device is the hearing device's ability to correct the individual's audiogram—i.e. to provide the right amplification of sounds relating to the individual's hearing loss. Usually, a hearing aid is delivered to an expert with no settings in the memory, or with a default setting of the manufacturer only used to verify the overall functionality of the hearing device. Hence, the expert is required to perform a hearing test, to obtain an audiogram, and subsequently to adapt all the characteristics of the hearing aid to approximately fit the individual needs of the hearing-impaired consumer. Depending on the hearing loss of the individual, the expert is required to fine-tune the settings in the hearing aid to match the individual's expectations, wherein the expert reprograms the hearing aid several times before the optimized parameter settings are obtained. Only then can the user form a final opinion about his satisfaction with the product.

Clearly, it would be desirable to simplify the overall fitting procedure towards an easier and quicker availability of the hearing aid. But even a fitting procedure rendered more effective by automation would ultimately require the assistance of an audiologist or another expert, at least to ensure the suitability of a hearing device for the individual user. This prerequisite, however, increases the complexity for the consumer, the waiting time before the consumer gets the hearing aid, and the purchase costs of a hearing aid.

Patent application no. WO-A-2006/058453 addresses the need for evaluating the personality characteristics of the individual as described above, in that it discloses a method of manufacturing a hearing device which is aimed to improve the fitting machine support of an expert in order to allow the consideration of a significant number of personal characteristics of an individual. The method comprises registering some non-audiogram characteristics of the individual, followed by establishing a personality profile in dependency of the registered data. After comparison with a number of predefined profiles the established profile is assigned to a stored non-audiogram fitting vector, which defines a set of characteristics that in a first approximation are to be established in the hearing device.

This is followed by the manufacturing process, wherein the fitting vector is applied to the hearing aid by an expert, who is also capable of choosing between different fitting vectors. This way various sound processing settings are established in the hearing aid, which assist in the overall fitting procedure. Thereafter, an expert has to evaluate in detail if the applied fitting vector complements the necessary audiogram adjustment and if the combined hearing aid settings are suited for the respective individual involved, and dependent thereon has to perform further adjustments of the hearing aid in direct communication with the individual. Due to the fact that the proposed personality fitting vector is applied separately from the audiogram correction the expert might consider the default settings as not applicable and is obliged to cancel the settings on the hearing aid.

Accordingly, it is an object of the present invention to propose a method and system for providing a hearing aid which is adapted to the individual's hearing loss, whereby the assistance of an expert, and hence a time-consuming and costly fitting procedure, can be avoided.

This object is achieved by a method for providing a hearing aid according to claim 1 or claim 15 or claim 16. The object is also achieved by a system for providing a hearing aid according to claim 18 or claim 19 or claim 21, by a set of hearing aids according to claim 17, by a hearing aid according to claim 20, and by a computer software product according to claim 22. Preferred embodiments are defined in the dependent claims.

Thus, the present invention firstly suggests that within a predetermined admissibility range of hearing loss, the different hearing losses, as expressed for example in an audiogram, can be categorized in a physiologically acceptable manner to a limited number of profiles. Secondly, the invention teaches that an environment can be defined for each profile allowing a satisfying compensation of hearing loss by an associated hearing aid. This allows for a hearing aid that is adapted to the individual's hearing loss to be provided without any further interaction of an expert, such as an audiologist, by automatically locating said associated environment within said admissibility range. Thereby, an immediate or a short-term delivery of a ready-to-wear hearing aid is accomplished, which provides satisfying corrections of an individual hearing loss located within said admissibility range, wherein a time-consuming and expensive optimization process performed by an expert is avoided.

The invention will be described in more detail in the following description of preferred exemplary embodiments with reference to the accompanying drawings. In the drawings.

Figure 9:
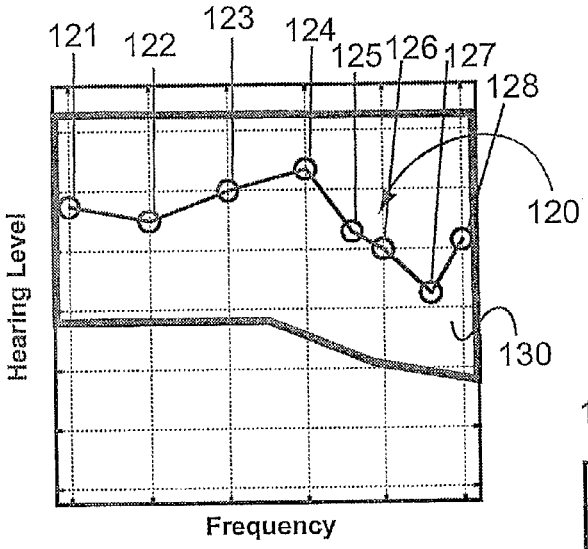
Figure 10:
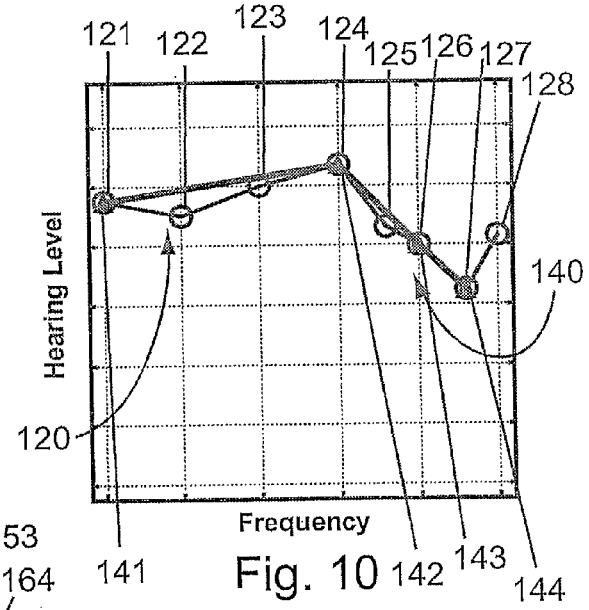
Figure 11:
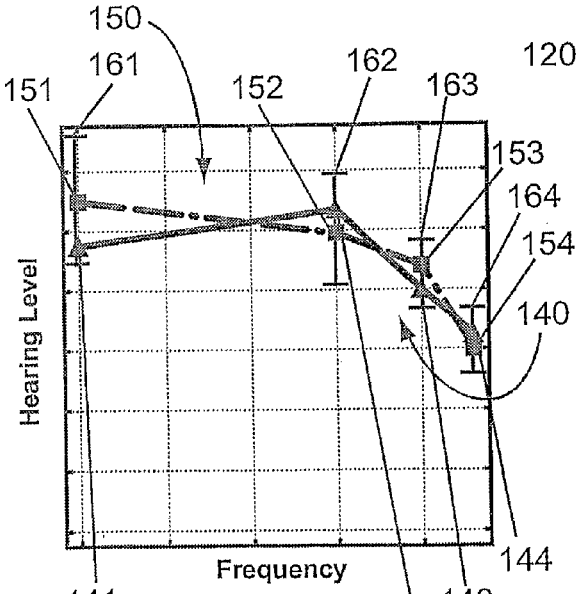

FIG. 8*a-d* are examples of audiograms of different types of hearing loss, which are categorized with respect to their characteristic lineshape;

FIG. 9 is a simplified audiogram which illustrates the step of measuring hearing loss and assessing the admissibility within a first decision procedure according to an embodiment of the invention;

FIG. 10 is the audiogram of FIG. 9 and a corresponding hearing loss profile which illustrate the step of converting said measured hearing loss according to an embodiment of the invention; and FIG. 11 is the hearing loss profile of FIG. 10 and a standardized profile with an associated admissibility array which illustrate the step of assessing the admissibility within a second decision procedure.

Figure 1:
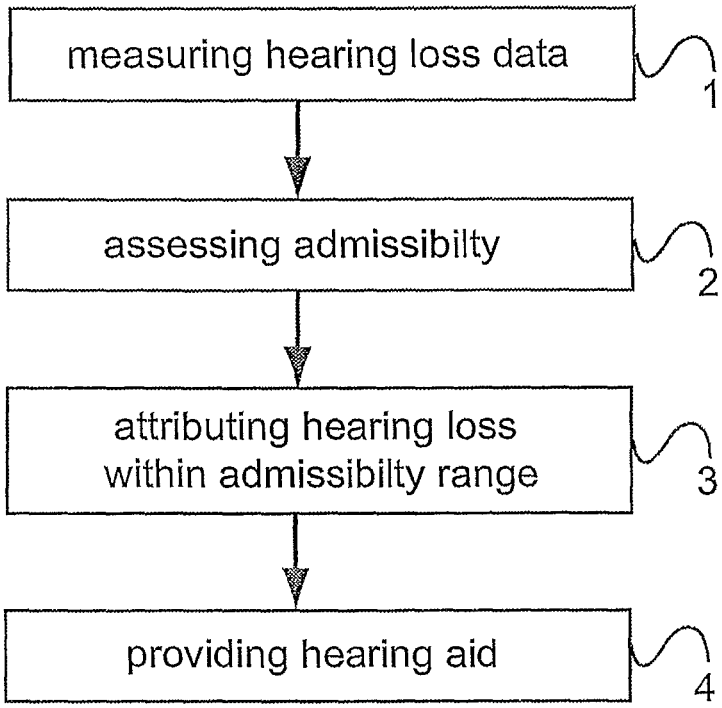
FIG. 1 is a block diagram which illustrates the basic steps of a method according to the invention.

FIG. 1 schematically depicts a process flow, in which the basic steps of a method for providing a ready-to-wear hearing aid which is adapted to the individual needs of a hearing aid user are represented.

In an initial step 1, hearing loss data is measured on a prospective or current hearing aid user. This is followed by a second step 2, in which the admissibility of the measured hearing loss is assessed automatically. The expression "automatically" refers to the fact that the evaluation is carried out by means of a data processor without any personal interaction. This is accomplished by determining if said measured hearing loss data is located within a predetermined admissibility range.

In a following step 3, said measured hearing loss data is attributed by the data processor to one of a set of standardized profiles. Each standardized profile corresponds to a certain type of hearing loss generally located within said admissibility range and is associated with a set of standardized programming parameters of a hearing aid. Standardization of said set of programming parameters implies a preprogrammed code that is readily provided, such that no further programming is required.

Finally, in a further step 4, a hearing aid is provided which is programmed according to those of said standardized programming parameters that are associated with said attributed standardized profile. In those situations—for example if the individual suffers from a profound hearing loss—where the hearing loss data falls outside the admissibility range, or does not correspond to one of the standardized profiles, the individual will be referred to an expert, who will be able to measure and evaluate the hearing loss in greater detail on the basis of a clinical picture.

The described method greatly simplifies the fitting process of a hearing aid on an individual in terms of time and cost savings, wherein an at least satisfying compensation of hearing loss for said individual is achieved. Due to the exclusion of an expert from the complete fitting procedure, said automatic assessment of admissibility 2 is an indispensable constituent of this method with respect to the applicability of said standardized programming parameters. Thereby, a restriction on the applicability of said standardized programming parameters is imposed within an admissibility range, in which an at least satisfying compensation of hearing loss is obtainable.

Said admissibility range is generally defined by a limited domain of measurable hearing loss, which can be correlated with a functional range of a hearing aid. Limitation of this domain presumes a certain quantity of measurable hearing loss which is not accounted for in said functional range of a hearing aid. For example, said admissibility range may be determined on the basis of a statistical evaluation of previously recorded hearing loss data. This may comprise a classification of hearing loss measurement results in several groups, each group corresponding to a different functional setting within said functional range of a hearing aid. This may also comprise an evaluation of the frequency of occurrence of identical or similar measurement results of said previously recorded hearing loss data.

For each hearing loss located within said admissibility range, a ready-to-wear hearing aid for the measured hearing loss will be deliverable subsequent to the execution of said method without any further interaction of an expert, such as an audiologist.

Figure 2:
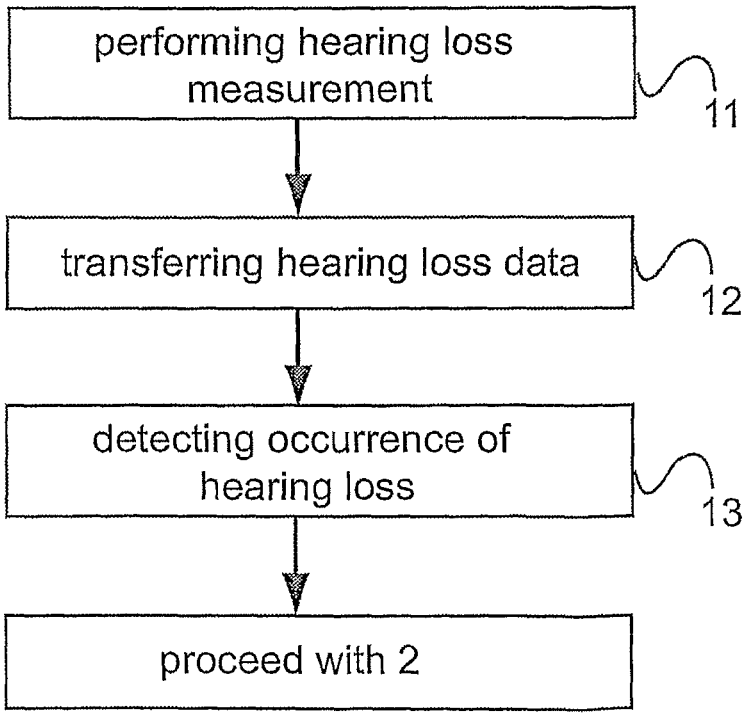
FIG. 2 is a block diagram which illustrates the step of measuring of hearing loss in the flow-chart according to FIG. 1.

The process flow depicted in FIG. 2 specifies said measuring of hearing loss data 1. The method is initiated by performing a hearing loss measurement 11 on an individual. This can comprise any testing method of phonetic perception, such as recording of a pure-tone audiogram or of vowel and/or speech and/or sound recognition. During or after that measurement, transferring of said measured hearing loss data 12 to a data processing unit is carried out.

Subsequently the factual occurrence of a hearing impairment may be detected 13 on said measured hearing loss data. This comprises an automatic evaluation whether at least a part of the data values of said hearing loss data exceeds a predetermined threshold value of hearing loss. For example, such a hearing threshold value can represent an approximate 20 dB attenuation as compared to a normalized value of regular hearing ability. If a significant number of measured data values falls below said respective hearing threshold value, the overall procedure will be stopped by the finding that no hearing impairment is present.

Figure 3:
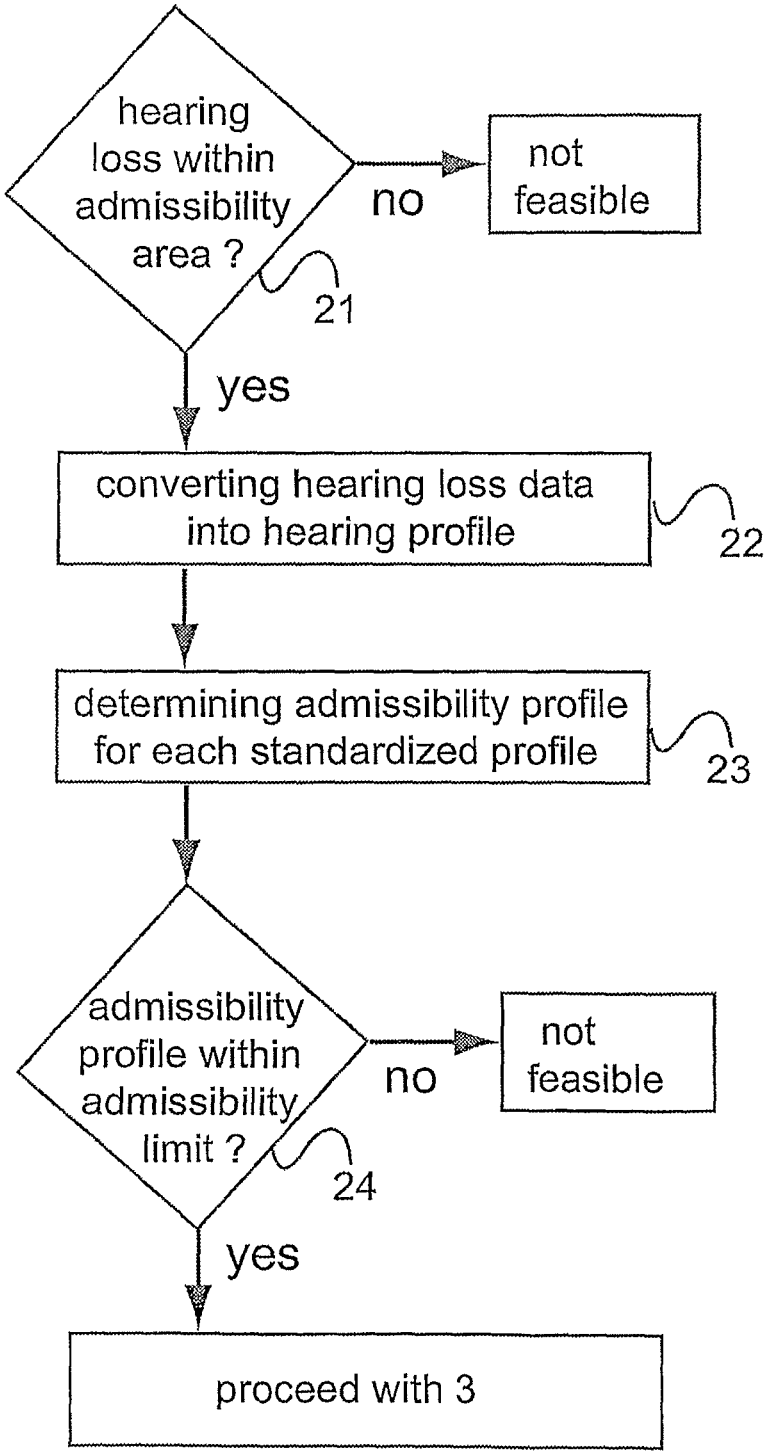
FIG. 3 is a block diagram which illustrates the step of assessing the admissibility in the flow-chart according to FIG. 1.

The process flow in FIG. 3 details the step of assessing the admissibility 2 of said measured hearing loss. It is executed automatically by the data processing unit after reading said transferred hearing loss data. Initially, a first decision criterion is applied 21 by evaluating for said measured hearing loss data whether or not it is enclosed by a continuous admissibility area. Thus, within a first decision procedure said predetermined admissibility range is represented by said continuous admissibility area. In case of an entire or fractional mismatch, the procedure will be stopped by the finding that no hearing aid can be provided which corresponds to the specific hearing loss.

Said first decision procedure might provide only a first estimation of the admissibility of said hearing loss data. Thus, if said measured hearing loss data is enclosed by the continuous admissibility area, a second decision procedure is initiated. For this purpose and depending on the number of data paints in the hearing test, converting of said measured hearing loss data into a hearing loss profile 22 may be required in order to allow an evaluation of said measured hearing loss data in direct correlation with each of said standardized profiles which are stored in the memory of said data processing unit. Said converting 22 may include the procedure of matching said measured hearing loss data to said standardized profiles by extracting a number of data points that are associated with a default number of data points of each standardized profile. For instance, an interpolation of at least two data points of said measured hearing loss data can be effected when necessary.

Based on the converted hearing loss profile, an admissibility profile is determined 23 for each standardized profile. This procedure is depicted in the process flow in FIG. 4 and further detailed in a subsequent paragraph. After creation, said admissibility profiles contain information that is generally related to the admissibility of said hearing loss data with respect to each standardized profile.

After those preparatory measures, said second decision procedure 24 is effectuated by evaluating for each of said admissibility profiles whether or not it is enclosed by said predetermined admissibility range. Therefore, the total number of data points for each standardized profile that are located within a predetermined admissibility limit associated to each data point is determined. Thus, within the second decision procedure said predetermined admissibility range is represented by said admissibility limits which define an upper and/or lower constraint of admissibility for each respective datapoint of said hearing loss profile. All admissibility limits for each standardized profile are stored in the data processing unit as admissibility arrays, such that at least one admissibility array is provided for each standardized profile. Depending on said determined total number of data points of each admissibility profile that are located within their admissibility limit, the corresponding standardized profile is then either selected or discarded by the data processing unit. For example, the localization of all data points of said hearing loss profile within their respective admissibility limit can be chosen as a prerequisite for the preservation of the admissibility range and thus for the selection of a respective standardized profile. In case of selecting at least one standardized profile, the data processing unit will continue with the step of attributing the hearing loss within the admissibility range 3. In case of no selection of an appropriate standardized profile the procedure will be stopped by the finding that no hearing aid that corresponds to the specific hearing loss can be provided.

Figure 4:
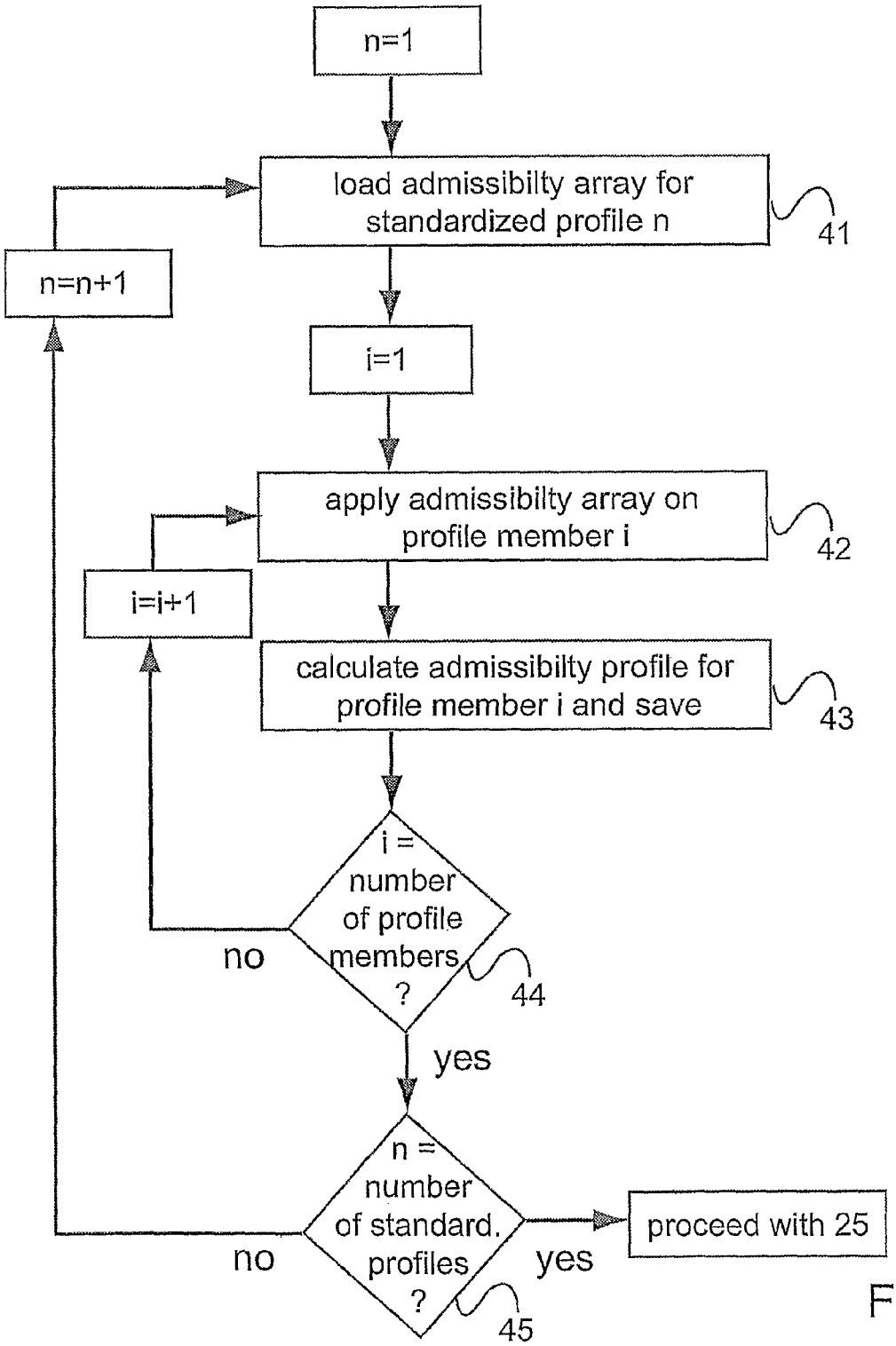
FIG. 4 is a block diagram which illustrates the step of determining an admissibility profile in the flow-chart according to FIG. 3.

In FIG. 4 the detailed process flow of determining an admissibility profile 23 is depicted. The procedure comprises two nested loops which allow a separate treatment of each of said standardized profiles and a specified number of profile members which are comprised by each standardized profile. For example, each standardized profile can correspond to a certain type of hearing loss and each comprised profile member can correspond to a different severity degree of the respective type of hearing loss.

The outer loop is initiated by loading a respective admissibility array 41 for the first standardized profile into the active memory of the data processing unit. The admissibility arrays are, as previously mentioned, stored in the data processing unit, wherein individual admissibility arrays associated with each standardized profile are provided for.

The inner loop is initiated by applying the loaded admissibility array to the first profile member 42 of the respective standardized profile. Thereby, said admissibility array defines an admissibility limit for each of a default number of data points of each profile member. In the next procedure 43, an admissibility profile for said profile member is determined by determining for each data point whether or not said measured hearing profile is located within the respective admissibility limit. For each data point the result is stored in said admissibility profile. Subsequently the inner loop is continued with the next profile member 44 until the admissibility profiles of all profile members of said standardized profile are determined. In the following step 45 the data processing unit proceeds with the outer loop until complete evaluation of all standardized profiles is accomplished in the described manner.

Figure 5:
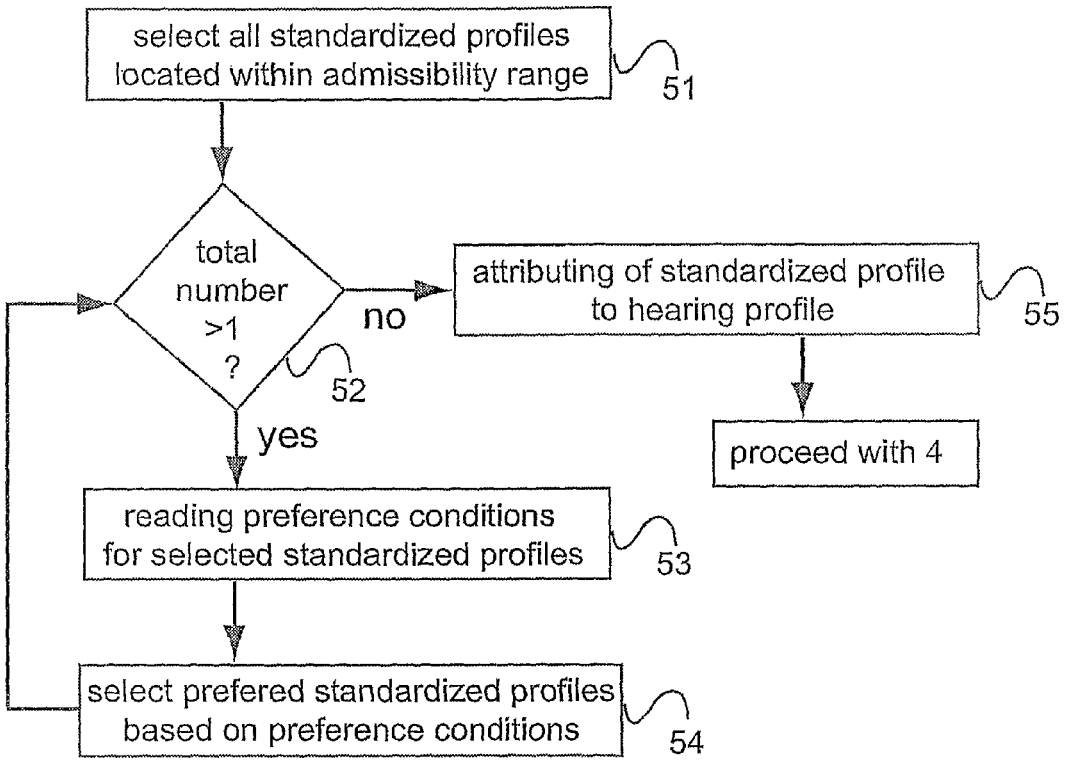
FIG. 5 is a block diagram which illustrates the step of attributing hearing loss within the admissibility range in the flow-chart according to FIG. 1.

FIG. 5 displays a flow chart which illustrates more specifically said attributing of hearing loss within the admissibility range 3. In the process, all previously selected standardized profiles are incorporated and an exclusion method is applied yielding one standardized profile according to predetermined preference conditions. The latter are stored in the data processing unit for each standardized profile. Therefore, if the determined number of selected standardized profiles in step 52 exceeds the value one, said preference conditions for each selected standardized profile are loaded 53 into the active memory of the data processing unit. For instance, said preference conditions can comprise accuracy arrays for each standardized profile, by which the congruence to any desired degree of said measured hearing profile with respect to said standardized profiles can be estimated. Based on said preference conditions each of said standardized profiles is either individually selected again 54 or discarded and the procedure returns to step 52. If the determined number of selected standardized profiles in step 52 equals the value one, the remaining standardized profile is attributed to the measured hearing profile 55 and the method continues with said step of providing of a hearing aid 4.

Figure 6:
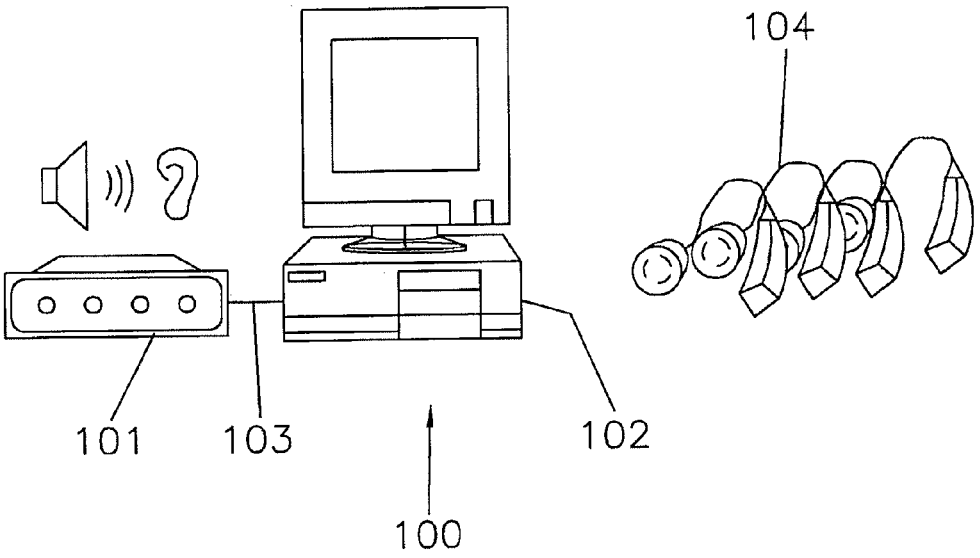
FIG. 6 is a schematic representation of a system for providing a hearing aid in a first embodiment according to the invention.

FIG. 6 displays a schematic representation of a system 100 automating the described method according to a first embodiment of the invention. The system 100 comprises a measuring means 101 that is adapted for measuring hearing loss data on an individual. The measured hearing loss data is transferable from said measuring means 101 to a data processing unit 102 via a transferring means 103. Said data processing unit 102 is configured to read said measured hearing loss data and to operate a method according to steps 1 to 3 pursuant to the preceding description. For instance, a computer program stored on a medium and capable of executing said method can be installed on a personal computer as the processing unit 102.

The system 100 further comprises a set 104 of preprogrammed hearing aids. Each hearing aid is programmed according to different standardized programming parameters, the set of standardized programming parameters being associated with at least one of said set of standardized profiles corresponding to different types of hearing loss generally located within said predefined admissibility range. Therefore, in said set 104 of preprogrammed hearing aids said different standardized programming parameters are physically separated, wherein each hearing aid corresponds to one standardized profile. One advantage of this physical separation is that, once a selection of one suitable hearing aid is accomplished, any misadjustment of preprogrammed parameters is effectively avoided.

In a method according to the first embodiment of the system 200, said providing 4 of a hearing aid comprises the step of selecting one hearing aid from said set 104 of preprogrammed hearing aids. The selection process is accomplished by the data processing unit 102 in a fully automated way by identifying the appropriate device from said set 104 of preprogrammed hearing aids associated with said standardized profile, which in step 3 has been attributed to said measured hearing loss data, and by outputting the device name or identifier or other visible distinction criteria of the selected device. After that step 4, the selected device is ready for immediate appliance on the hearing aid user or can be subject to secondary adjustments beforehand, as described below.

According to an embodiment of the invention, all secondary adjustments can be conducted immediately on said selected hearing aid without any interaction of an expert. For instance, volume adjustments or size fittings are comprised by said secondary adjustments. In one embodiment, a number of different sizes of the tube of the hearing aid can be included in order to allow an easy adjustment on individual ear canal sizes. Another embodiment comprises a wheel and/or a number of push buttons on each hearing aid in order to provide an external operator interface for said secondary adjustments.

According to a further embodiment such an external operator interface can be provided as a means to toggle between different programming parameters that are associated with a number of different profile members of one standardized profile and that are preprogrammed on each single hearing aid of the set of hearing aids 104. In a method according to this embodiment, the correct settings of said operator interface are identified and output by the data processing unit 102, according to the attributed standardized profile. For example, different programming parameters corresponding to a different severity degree of one specific type of hearing loss can be adjustable on said single hearing aid that is preprogrammed with different profile members of a standardized profile, wherein the correct settings are determined and output by the data processing unit 102. Thereby, the different programming parameters on said single hearing aid are also readjustable, e.g. in case of aggravation of the respective hearing loss, after executing again the method described above.

Figure 7:
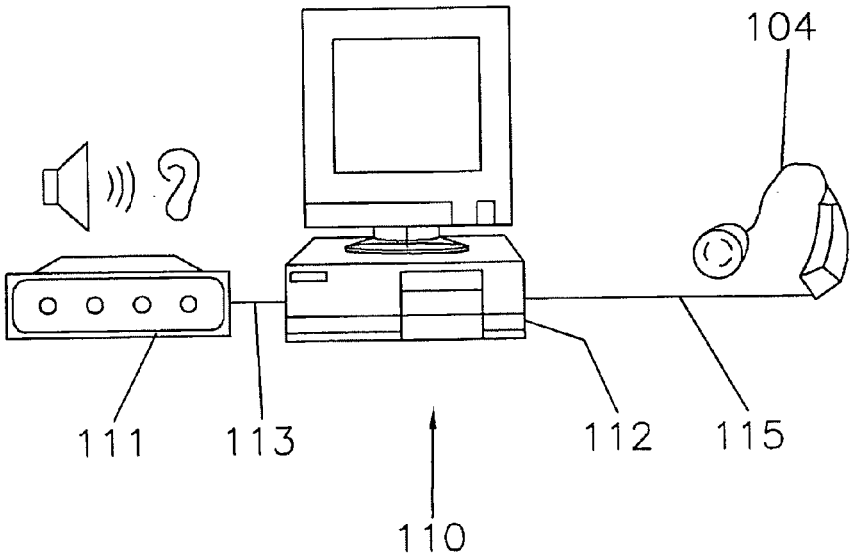
FIG. 7 is a schematic representation of a system for providing a hearing aid in a second embodiment according to the invention.

In FIG. 7, a system 110 automating the described method according to a second embodiment of the invention is shown in a schematic representation. Supplementary to a measuring means 111, a data processing unit 112 and a transferring means 113 in compliance with the above description, the system 110 comprises at least one programmable hearing aid 114 and a transferring means 115, which may be for example a cable or wireless and is adapted to transfer a preprogrammed data file from said processing unit 112 to said hearing aid 114.

In the method according to the second embodiment of the system 110, said providing 4 of a hearing aid comprises the step of transferring preprogrammed data to the memory of said programmable hearing aid 114. Said preprogrammed data comprises those standardized programming parameters that are associated with said attributed standardized profile, which in step 3 has been attributed to said measured hearing loss data. After that step 4, the selected device is ready for immediate appliance on the hearing aid user or can be subject to secondary adjustments beforehand, as previously described.

A third embodiment automating the described method basically corresponds to the system 110 shown in FIG. 7, not comprising said transferring means 115 and in which said programmable hearing aid 114 is replaced by a single hearing aid that is preprogrammed with all standardized programming parameters associated with each standardized profile of said set of standardized profiles. Said single hearing aid further comprises a switch mechanism which allows to individually select the respective programming parameters associated with each standardized profile. Such a switch mechanism might comprise an operator interface provided inside or outside of the casing of said single hearing aid. For example, said switch mechanism can be represented by an external or internal push button and/or trimmer control. Preferably, said switch mechanism is adapted for rigor fixation in each of its switching positions, such that an accidental or arbitrary misadjustment of said selected programming parameters is effectively avoided.

In a method according to the third embodiment of the system, said providing 4 of a hearing aid comprises the step of adjusting said switch mechanism on said preprogrammed hearing aid according to those programming parameters that are associated with said attributed standardized profile. Thereby, the data processing unit 112 determines and outputs the correct switching position of said switching mechanism, which corresponds to the programming parameters associated with said attributed standardized profile. After that step 4, the selected device is ready for immediate appliance on the hearing aid user or can be subject to secondary adjustments beforehand, as previously described.

A fourth embodiment of a system according to the invention consists of said set of hearing aids 104, as depicted in FIG. 6. In such a system, the categorization of hearing loss in standardized profiles each of which is accounted for in a respective hearing aid within the set 104 allows an individual to select a suitable hearing aid on the basis of a trial and error procedure. Preferably, the individual performs several hearing tests by wearing each hearing aid out of the set 104 successively, which then allows the individual to choose the best performing device or to disapprove the selection. This way, due to said categorization of hearing loss, the effectual selection of a hearing aid accounting for a hearing loss located within said admissibility range may be accomplished by the individual user himself, depending on his varying hearing perception in the sequence of hearing tests. This further permits the individual user to form a decision based on personal preferences which may be related to, for example, a different sound perception depending on language, professional or private life situation, etc. In this embodiment of an individualized selection procedure, however, the risk of selection of a badly performing device cannot be excluded, e.g. in the case that the individual's hearing loss is located outside said admissibility range and no appropriate hearing aid can be provided at all.

A fifth embodiment of a system according to the invention consists of a single hearing aid that is preprogrammed with all standardized programming parameters associated with each standardized profile of said set of standardized profiles.

Said single hearing aid further comprises a switch mechanism for an individual selection of respective programming parameters, as previously described in the third embodiment of a system. This allows the individual user, in a second embodiment of an individualized selection procedure, to select suitable programming parameters according to his personal preferences based on a trial and error procedure. Preferably, the individual performs several hearing tests by wearing said preprogrammed hearing aid and by setting different standardized programming parameters on said switch mechanism successively, which then allows the individual to choose the best performing preprogrammed parameters. As in the first embodiment of an individualized selection procedure, the risk of selection of badly performing programming parameters cannot be excluded.

Another embodiment of a method according to the invention comprises a combination of two methods, namely the previously described method based on automatic assessment of admissibility 2 combined with the individualized selection procedure. Thereby, said risk of selecting a bad performing device and/or badly performing programming parameters is effectively avoided, wherein the personal preferences of the individual user are still taken into account.

According to an embodiment of the invention, a categorization of hearing loss into different types, for which above described methods are applicable in a physiologically acceptable manner, can be effected in various ways. An example is shown in FIG. 8*a-d*, wherein examples of different types of hearing loss are categorized with respect to their characteristic lineshape in a frequency audiogram.

Figure 8A:
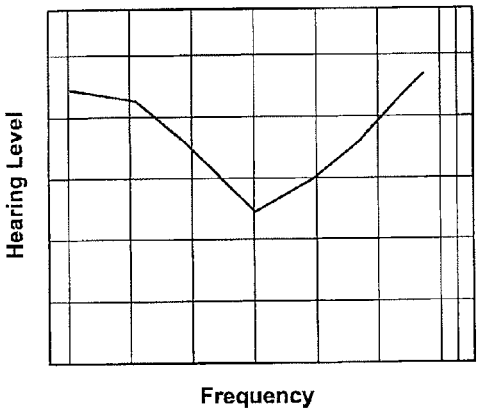

FIG. 8*a* depicts a cookie bite type of hearing loss corresponding to a substantially V-shaped line in the audiogram with a pronounced minimum in the mid-frequency range.

Figure 8B:
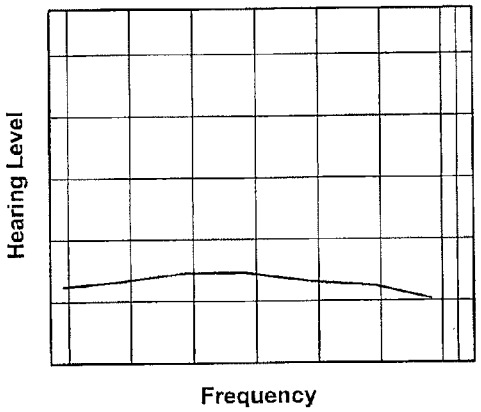

FIG. 8*b* depicts a flat type of heating loss corresponding to a hearing loss with a substantially flat but lowered lineshape as compared to a regular hearing profile.

Figure 8C:
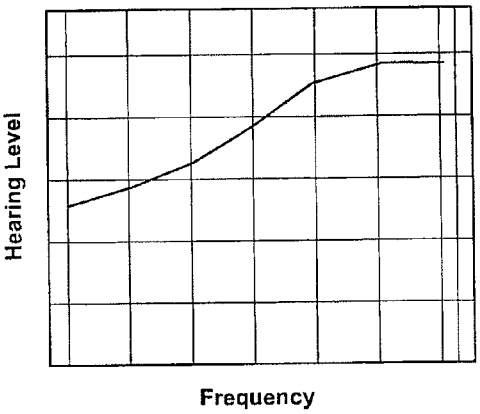

FIG. 8*c* depicts a reverse ski slope type of hearing loss corresponding to a hearing loss which is worse at lower frequencies as compared to the higher frequencies with an increasing lineshape.

Figure 8D:
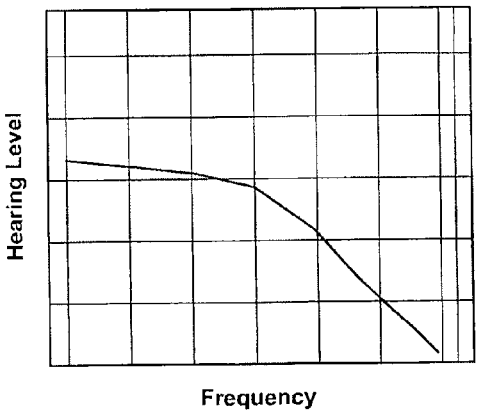

FIG. 8*d* depicts a ski slope type of hearing loss corresponding to an audiogram with a decreasing lineshape over the whole frequency range.

Within all these types of hearing loss, an assessment is required whether the measured hearing loss data is located within the boundaries, as defined by the admissibility range according to an embodiment of the invention. For example, depending on the severity degree of the hearing loss or a particular amplification needed in a given frequency range, an individual hearing loss might be located outside the admissibility range, as automatically determined.

Corresponding to the exemplary categorization of hearing loss set forth above, standardized profiles can be defined for each type of hearing loss. In particular, standardized profiles can consist of one hearing loss type that is quantitatively substantiated or can comprise a number of profile members sharing one characteristic lineshape of a given hearing loss type. For example, each profile member can correspond to a different severity degree of the respective hearing loss type. Thereby, the exact lineshape can deviate between different profile members, though the overall behavior according to said categorization is substantially preserved.

According to another embodiment of the invention, the different standardized profiles can be defined as different severity degrees of hearing loss. These standardized profiles can also comprise profile members, as previously described, e.g. each profile member corresponding to a different characteristic lineshape according to FIGS. 8*a-d*. Furthermore, any subcategorization of profile members is conceivable, by which each profile member comprises a number of different subprofile members.

It is understood that any categorization of standardized profiles that exhibit at least one distinguishable feature is conceivable. This can comprise e.g. a number of audiograms that are substantially identical over a first frequency range and slightly differ over a second frequency range. Furthermore, the standardized profiles can consist of a number of audiograms that all can be categorized within one characteristic lineshape according to FIGS. 8*a-d*, or can comprise a first number of audiograms categorized within a first characteristic lineshape and a second number of audiograms categorized within a second characteristic lineshape, etc.

For the sake of clarity, an example of a method according to the invention will be further illustrated in the subsequent description by means of a simplified example.

FIG. 9 depicts an audiogram 120, which has been measured on an individual according to step 1 of the above described method. The audiogram 120 comprises eight distinct data points 121 to 128 for different frequency values. The first decision procedure 21 is executed by overlaying a continuous admissibility area 130 on the audiogram 120 and evaluating whether or not the data points 121 to 12B are comprised within the admissibility area. Here, the audiogram 120 is entirely located within the admissibility area.

FIG. 10 illustrates the step 22 of the above described method in which the measured audiogram 120 is converted into a hearing loss profile 140, which then can be correlated to said standardized profiles. This implies extracting a number of data points 121, 124, 126 and 127 from the audiogram 120, which form the data points 141, 142, 143 and 144 of the hearing loss profile 140. In the example, the frequency values required for the hearing loss profile 140 do coincide with respective frequency values of the measured audiogram 120. If different frequency values are required an interpolation of data points in the audiogram 120 can be applied.

FIG. 11 illustrates the step 23 of determining an admissibility profile for each standardized, profile according to the above described method. A standardized profile 150 is loaded together with its associated admissibility array. The admissibility array in essence consists of individual admissibility limits 161 to 164 for each data point 151 to 154 of the standardized profile 150. The respective admissibility profile is determined by identifying for each data point 141 to 144 of the hearing loss profile 140 whether or not it is located within the respective admissibility limit 161 to 164 of the data points 151 to 154 of the standardized profile 150. After successively determining an admissibility profile for each standardized profile the second decision procedure 24 is initiated, in which the standardized profile 150 is either selected or discarded on the basis of its admissibility profile. In case of a selection of the standardized profile 150, a ready-to-wear hearing aid with corresponding programming parameters can be provided, which corresponds to the measured hearing loss.

It should be understood that while certain variants of the present invention are illustrated and described herein, the invention is defined by the claims and is not to be limited to the specific embodiments described and shown. For example, although the specific embodiments described herein for determining if said measured hearing loss data is located within a predetermined admissibility range are based on a continuous admissibility area and/or on admissibility arrays and/or on admissibility profiles, variations on these embodiments are contemplated in which any other information processing method is employed in order to relate measured hearing loss data to a predetermined admissibility range. Further conceivable is any other representation of standardized profiles than audiograms.

The invention claimed is:

1. A method for providing a hearing aid, which is adapted to the individual needs of a hearing aid user, the method comprising:

assessing the admissibility of previously measured hearing loss for the hearing aid user by determining if measured hearing loss data is located within a predetermined admissibility range and stopping the method in case of an entire or fractional mismatch;

if the measured hearing loss data is located within the predetermined admissibility range, converting the measured hearing loss data into a hearing loss profile by extracting a number of data points that are associated with a predetermined number of data points of each of a set of standardized profiles;

attributing said hearing loss profile to one of the set of standardized profiles, wherein each standardized profile includes a set of data points corresponding to a certain type of hearing loss generally located within said admissibility range and is associated with a set of standardized programming parameters of a hearing aid; and providing a hearing aid which is programmed according to the set of standardized programming parameters that is associated with said attributed standardized profile.

2. The method according to claim 1, wherein said providing of a hearing aid comprises selecting one hearing aid from a set of preprogrammed hearing aids each preprogrammed with a different set of standardized programming parameters.

3. The method according to claim 1, wherein said providing of a hearing aid comprises transferring preprogrammed data to memory of a programmable hearing aid, wherein said preprogrammed data comprises the set of standardized programming parameters that are associated with said attributed standardized profile.

4. The method according to claim 1, wherein said providing of a hearing aid comprises adjusting a switch mechanism on a hearing aid preprogrammed with all standardized programming parameters associated with each standardized profile of said set of standardized profiles.

5. The method according to claim 1, wherein said assessing the admissibility comprises:

determining an admissibility profile for each of said standardized profiles with respect to said measured hearing loss data;

evaluating for each of said admissibility profiles whether or not it is enclosed by said predetermined admissibility range.

6. The method according to claim 5, wherein said determining of an admissibility profile comprises applying at least one predefined admissibility array which defines an admissibility limit for each of a predetermined number of data points of each standardized profile, wherein said admissibility profile is determined by identifying for each data point whether or not said hearing loss profile is located within the respective admissibility limit.

7. The method according to claim 6, wherein individual admissibility arrays are generated for different standardized profiles.

8. The method according to claim 6, wherein said evaluating of each of said admissibility profiles comprises determining the total number of data points that are located within the respective admissibility limit.

9. The method according to claim 1, wherein said converting comprises interpolating at least two data points of said measured hearing loss data.

10. The method according to claim 1, wherein said assessing the admissibility comprises evaluating whether or not said measured hearing loss data is enclosed by a continuous admissibility area.

11. The method according to claim 1, wherein said set of standardized profiles comprises a specified number of profile members for each type of hearing loss.

12. The method according to claim 11, wherein each of said profile members corresponds to a different severity degree of the respective type of hearing loss.

13. The method according to claim 1, wherein before said assessing the admissibility, the occurrence of hearing loss is detected on said measured hearing loss data by evaluating whether said measured hearing loss data exceeds a predetermined threshold value of hearing loss.

14. A system for providing a hearing aid, which is adapted to the individual needs of a hearing aid user, the system comprising:

a set of hearing aids, each of the set of hearing aids being preprogrammed according to standardized programming parameters that are associated with at least one of a set of standardized profiles corresponding to different types of hearing loss generally located within a respective predefined admissibility range for each respective one of the set of hearing aids; and one or more non-transitory computer-readable storage devices or memory configured to store one or more computer-executable instructions that when executed by a computer, cause the computer to perform a method, the method comprising:

assessing the admissibility of previously measured hearing loss for the hearing aid user by determining if measured hearing loss data is located within a predetermined admissibility range and if there is an entire or fractional mismatch, stopping the method and indicating that no hearing aid can be provided which corresponds to the previously measured hearing loss;

converting the measured hearing loss data into a hearing loss profile by extracting a number of data points that are associated with a predetermined number of data points of each of the set of standardized profiles;

attributing said hearing loss profile to one of the set of standardized profiles, wherein each standardized profile corresponds to a certain type of hearing loss generally located within said admissibility range and is associated with a set of standardized programming parameters of a hearing aid from the set of hearing aids; and selecting a hearing aid from the set of hearing aids according to the set of standardized programming parameters that is associated with said attributed standardized profile.

15. The system of claim 14, wherein:

each of the set of standardized profiles is categorized within one characteristic lineshape.

16. The system of claim 14, wherein:

at least one of the set of standardized profiles is categorized within a first characteristic lineshape and at least one other one of the set of standardized profiles is categorized within a second characteristic lineshape different than the first characteristic lineshape.

17. The system of claim 14, wherein:

a first one of the set of standardized profiles is categorized with a characteristic lineshape and a second one of the set of standardized profiles is categorized with a different characteristic lineshape; and the characteristic lineshape of the first standardized profile intersects the characteristic lineshape of the second standardized profile.

18. The system of claim 14, wherein:

a first one of the set of standardized profiles is categorized with a characteristic lineshape and a second one of the set of standardized profiles is categorized with a different characteristic lineshape;

the characteristic lineshape of the first one of the set of standardized profiles corresponds to a substantially V-shaped line with a minimum in a mid-frequency range; and the characteristic lineshape of the second one of the set of standardized profiles corresponds to one of the following: a substantially flat but lowered lineshape, a hearing loss which is worse at lower frequencies as compared to the higher frequencies with an increasing lineshape, or a decreasing lineshape over the entire predefined admissibility range.

19. One or more non-transitory computer-readable storage devices or memory configured to store one or more computer-executable instructions that when executed by a computer, cause the computer to perform a method, the method comprising:

assessing the admissibility of previously measured hearing loss for a hearing aid user by determining if said measured hearing loss data is located within a predetermined admissibility range and if there is an entire or fractional mismatch, providing an indication that no hearing aid can be provided which corresponds to the previously measured hearing loss;

converting the measured hearing loss data into a hearing loss profile by extracting a number of data points that are associated with a predetermined number of data points of each of a set of plural standardized profiles, wherein the data points of each of the set of plural standardized profiles are each located within the predetermined admissibility range;

attributing said hearing loss profile to one of a set of standardized profiles, wherein each standardized profile corresponds to a certain type of hearing loss generally located within said admissibility range and is associated with a set of standardized programming parameters of a hearing aid.

* * * * *